US009470009B2

(12) United States Patent
Santo

(10) Patent No.: US 9,470,009 B2
(45) Date of Patent: Oct. 18, 2016

(54) ATTACHING GLASS TO STONE

(71) Applicant: Roy Santo, Orem, UT (US)

(72) Inventor: Roy Santo, Orem, UT (US)

( * ) Notice: Subject to any disclaimer, the term of this patent is extended or adjusted under 35 U.S.C. 154(b) by 0 days.

(21) Appl. No.: 14/811,134

(22) Filed: Jul. 28, 2015

(65) Prior Publication Data

US 2016/0032611 A1 Feb. 4, 2016

Related U.S. Application Data

(60) Provisional application No. 62/032,636, filed on Aug. 4, 2014.

(51) Int. Cl.
*E04B 1/00* (2006.01)
*E04H 13/00* (2006.01)

(52) U.S. Cl.
CPC ..... *E04H 13/00* (2013.01)

(58) Field of Classification Search
CPC ..... E04H 13/00
USPC ..... 52/742.1, 742.16, 747.11, 103
See application file for complete search history.

(56) References Cited

U.S. PATENT DOCUMENTS 1,857,856 A * 5/1932 Medina ..... E04F 13/0862 156/252
3,463,653 A * 8/1969 Letter ..... B44F 9/04 264/162
4,036,929 A * 7/1977 Gould ..... B44C 1/221 264/129
4,126,500 A * 11/1978 Palanos ..... B44C 1/02 156/154
4,318,946 A * 3/1982 Pavone ..... B44F 1/063 156/63
5,273,620 A * 12/1993 Lamberti ..... B44C 1/225 156/153
5,525,137 A * 6/1996 DiCarlo ..... C03C 17/04 427/279
5,662,847 A 9/1997 Uchida et al.
5,669,951 A 9/1997 Eichhorn
5,740,653 A * 4/1998 Dubizhansky ..... C04B 41/009 52/742.16
5,903,961 A 5/1999 Parker et al.
6,696,136 B2 * 2/2004 Baldwin ..... B44C 1/28 428/172
7,374,472 B2 5/2008 Zheng
7,628,884 B2 * 12/2009 Berselli ..... B44C 3/10 156/293
7,909,028 B2 3/2011 Spurgeon
7,981,962 B1 * 7/2011 Schad ..... C04B 26/06 206/223

(Continued)

FOREIGN PATENT DOCUMENTS

CA 2670324 A1 12/2010
WO 2010139199 A1 12/2010

OTHER PUBLICATIONS

"Cutting Glass" WaterJets.Org. http://www.waterjets.org/index.php?option=com_content&task=view&id=107&Itemid=31, Accessed Sep. 22, 2014, 3 pages.

(Continued)

*Primary Examiner* — Basil Katcheves
*Assistant Examiner* — Joshua Ihezie
(74) *Attorney, Agent, or Firm* — Michael B. Dodd; Dodd Law Group, LLC

(57) ABSTRACT

The present invention extends to methods for attaching a piece of glass to a piece of stone. In some aspects, specifically designed glass inlays are secured within a void in a piece of stone. The glass inlays can include colored glass letters, numbers, designs, etc. In some aspects, glass inlays and voids are specifically designed to match one another. Glass inlays can be affixed within the voids using an adhesive. Grout can be then be used to set the glass inlays in place. The result can be monument or marker that commemorates an event or person.

12 Claims, 5 Drawing Sheets

(56) References Cited

U.S. PATENT DOCUMENTS

| | | | | |
|---|---|---|---|---|
| 8,298,044 | B2 | 10/2012 | Spurgeon | |
| 8,568,202 | B2 | 10/2013 | Spurgeon | |
| 8,834,665 | B1 * | 9/2014 | Morse | B32B 38/04 156/265 |
| 2003/0019571 | A1 | 1/2003 | Zanzuri | |
| 2005/0126225 | A1 | 6/2005 | Jaunzemis et al. | |
| 2007/0232199 | A1 | 10/2007 | Zheng | |
| 2009/0107071 | A1 * | 4/2009 | Starke | E04F 15/04 52/385 |
| 2010/0148393 | A1 * | 6/2010 | Carrillo | B29C 33/3857 264/227 |
| 2011/0274915 | A1 * | 11/2011 | Roberson | B29B 17/0042 428/327 |
| 2012/0065050 | A1 * | 3/2012 | Nieminen | B44C 5/005 501/32 |
| 2013/0022752 | A1 * | 1/2013 | Antonakas | C23C 16/0245 427/444 |
| 2014/0049949 | A1 | 2/2014 | Spurgeon | |
| 2014/0326388 | A1 * | 11/2014 | Martin | B44C 1/28 156/63 |

OTHER PUBLICATIONS

"Inlaid Stone" Tile Fantastic.Com. http://www.tilefantastic.com/Matrl.html, Accessed on Sep. 22, 2014, 3 pages.

* cited by examiner

ATTACHING GLASS TO STONE

CROSS-REFERENCE TO RELATED APPLICATIONS

This application claims the benefit of U.S. Provisional Patent Application Ser. No. 62/032,636, entitled "Attaching Glass To Stone", filed Aug. 4, 2014 which is incorporated herein in its entirety.

BACKGROUND

The memorial industry is based on the idea of permanency—that what you leave as a memorial will be there for the generations. Monuments that use granite or other hard stone last indefinitely. They are relatively unaffected by environmental factors such as heat, cold, ice, rain, snow, and Ultra Violet (UV) exposure. However, the paint or stain that is used to mark or beautify the stone is susceptible to these factors. Sometimes notable fading occurs even after a few years.

Fading and failing of a coating can occur due to a number of influences. Many coatings have a difficult time adhering to stone. UV exposure destroys and bleaches many colors and pigments, which causes fading over time. UV exposure degrades, and eventually destroys, the binder that clings the pigments to the stone. As the binder degrades, the paint or stain can go chalky and eventually flake or blister and wear off. Further, since the binder fails over time, some pigments, like carbon black (which resists fading) can leach or bleed into other areas. Lime particles from rainwater or irrigation water can then permanently trap the leached pigments onto the areas that were intended to remain unpainted.

In general, granite markers have a life expectancy of several centuries or even millennia. However, applied coatings (e.g., paint) can wither away in a much shorter period of time, for example, anywhere between three and 15 years. Coatings applied to sandstone or marble can fade even faster. Sandstone or marble markers erode such that they become chalky or sandy and become impossible to read the inscriptions.

BRIEF DESCRIPTION OF THE DRAWINGS

The specific features, aspects and advantages of the present invention will become better understood with regard to the following description and accompanying drawings where.

DETAILED DESCRIPTION

Figure 1A:
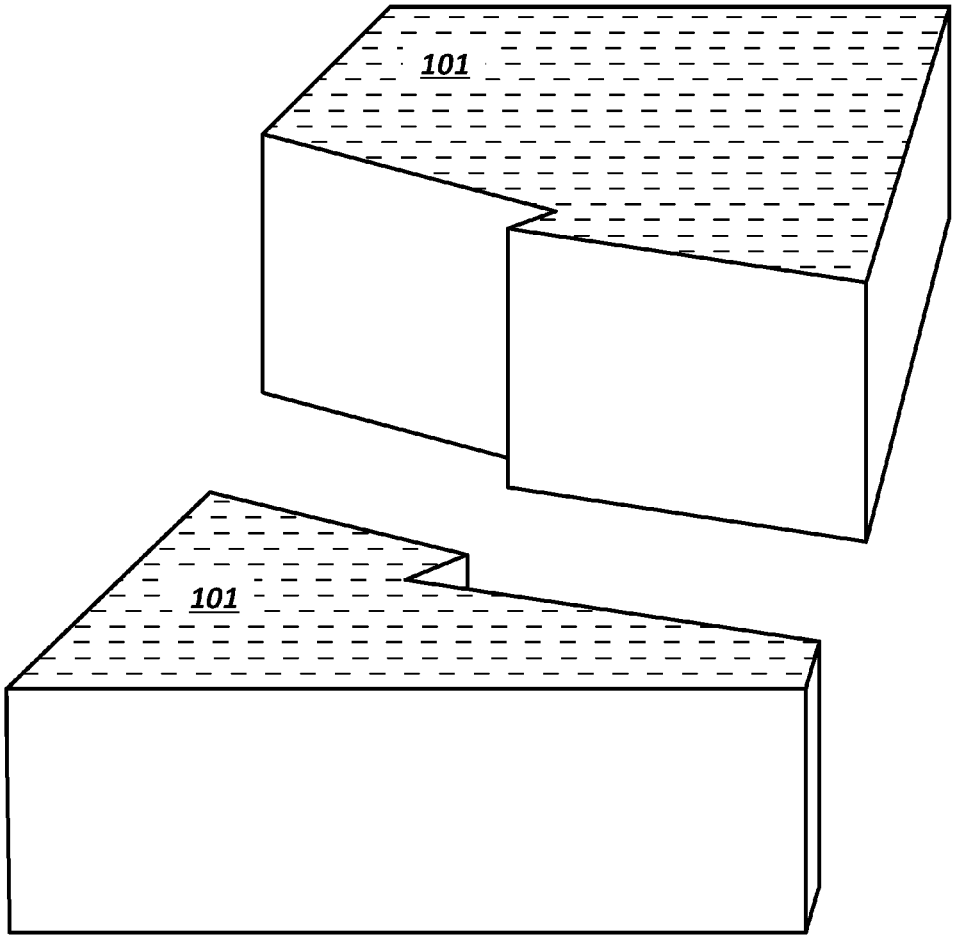
FIG. 1A illustrates an example of a piece of stone.

The present invention extends to methods, systems, and products for increasing the longevity of color used for marking stone, such as, on monuments, mausoleums, etc. In the following description of the present invention, reference is made to the accompanying drawings, which form a part hereof, and in which is shown by way of illustration, a specific implementation. It is understood that other implementations may be utilized and structural changes may be made without departing from the scope of the present invention.

In general, aspects of the invention include a piece of stone. In some aspects, the piece of stone has been formed or shaped for a specified purpose, for example, a stone marker, monument, memorial, obelisk, statue, plaque, column, pillar, headstone, gravestone, tombstone grave marker, or other type of marker. The piece of stone can be of any orientation, such as, horizontal, vertical, or diagonal orientations. The piece of stone can include inscriptions and/or designs. The inscriptions and/or designs can communicate a message and/or can be for aesthetic purposes. The inscriptions and/or designs can be used to commemorate a person or event. The piece of stone can be embedded within and/or appended to other bodies.

Using a computer-aided plotter, a sandblasting stencil is created to apply to a piece of stone. Using the sandblasting stencil, a void can be formed (e.g., cut) into the piece of stone. Alternatively, a router with a stone bit could be used to shape a similar kind of void into a piece of stone. A void can be anywhere from 1 mm to 25 mm deep. Different portions of a void can also have different depths.

One or more pieces of glass can be inlaid into the void. Inlaying glass includes embedding or inserting glass into another material, such as, for example, stone. The one or more pieces of class can (e.g., collectively) represent a design, pattern, or message. The one or more pieces of glass can be created in any number of different ways including cutting the one or more pieces of glass with a computer numerically controlled (CNC) water-jet.

The one or more pieces of glass can also be ground smooth, for example, using a diamond studded grinder. Each piece of glass can be clear, opaque, solid colored or semi-transparent or translucent. When a plurality of pieces of glass is used, each piece glass can have similar or different visual characteristic (e.g., color, opaqueness, translucence, etc.).

Ground color glass dust can be applied to another piece of glass (e.g., a piece of glass cut with a CNC water jet). The ground color glass dust can be painted onto the other piece of glass. Alternately, ground color glass dust can be screen printed onto another piece of solid glass. Applying different color ground color glass dust to a piece of glass essentially permanently attaches color to the piece of glass upon re-firing or heating the glass to its melting point. After the melting point is reached, the temperature can be dropped to the glass annealing temperature and an annealing schedule can be followed. Different melting and annealing temperatures can apply to different types of glass. When appropriate fusing and annealing schedules are followed, an individual piece of glass becomes a solid mass resulting in glass that is stronger and resistant to thermal shock cracking.

Colored glass can hold its color for long periods of time (essentially permanently). For example, colored glass can hold color for periods of time on the same order of magnitude as natural stone. As such, colored glass is well suited for use with stone, since both colored glass and the natural stone can hold color for hundreds or potentially even thousands of years.

A piece of glass can be flat, beveled or rounded. The piece of glass can be high gloss or acid etched for a satin sheen or sandblasted with a (e.g., ultra-fine) media to remove the sheen. Examples, of glass inlays include, but are not limited to, custom letters, numbers, and designs.

In some aspects, a void formed into a piece of stone is configured to receive one or more pieces of glass inlayed into the void. The thickness of the glass can vary, such as, for example, from 1 mm to 20 mm. The glass may be thick enough to protrude out of the void, giving a more dramatic experience. In one implementation, where the glass is not likely to be walked on (e.g., a vertical piece of stone), a 2.5 mm thick glass pane could be used. However, for more robust installations, greater thicknesses of glass panes can be used. For higher strength, a 12 mm thick glass pane could be used.

The depth of a void can be varied, for "flush mount" applications of glass inlays the depth can be 0.5 mm to 2 mm deeper that the glass thickness.

Adhesive can be used to affix a piece of glass to a piece of stone. The adhesive can be epoxy or polyester based, tile mastic, thinset mortar, etc. The adhesive can be applied to the glass inlay and then the void or can be applied to the void and then the glass inlay.

On the face of a piece of stone, where a piece of glass is to be inlayed, a void can be cut to accept one or more pieces of glass. For example, if a piece of glass in the form of a letter is to be inlayed into a piece of stone, a void in the form of the letter (or at least the external dimensions of the letter) can be cut into the stone. The void for receiving a piece of glass can be cut somewhat larger than the piece of glass. Thus, after the piece of stone is affixed into the void, there may be some space between the edge of the price of glass and the edge of the void. In some aspects, the void is at least 1 mm larger around the edges than an inlaid piece of glass (on inlaid pieces of glass). Thus, after the piece of glass is (or pieces of glass are) inlayed, there is at least a 1 mm gap between the edge of the void and the edge of the piece of glass.

Grout can be used to fill in the gap. Grout can be cement based, and can be either "sanded" or "non-sanded". The grout protects the adhesive from UV exposure, increasing the longevity of the bond between the piece of glass and the piece of stone. The grout also affixes the piece of glass within the plane of application, essentially centering the piece of glass in the void. The grout can be tinted virtually any color, for example, using lightfast and/or alkalinity fast pigments, adding further variety to the display. The alkalinity of cement-based grout etches the glass and walls in the void creating a further bond between the glass, grout and stone.

When multiple pieces of glass are affixed within the same void, grout can also be used to fill in any gaps between the pieces of glass.

FIG. 1A illustrates an example of a piece of stone 101. Piece of stone 101 can be or be part of a stone marker, monument, memorial, obelisk, statue, plaque, column, pillar, headstone, gravestone, tombstone, grave marker, or other type of marker.

Figure 1B:
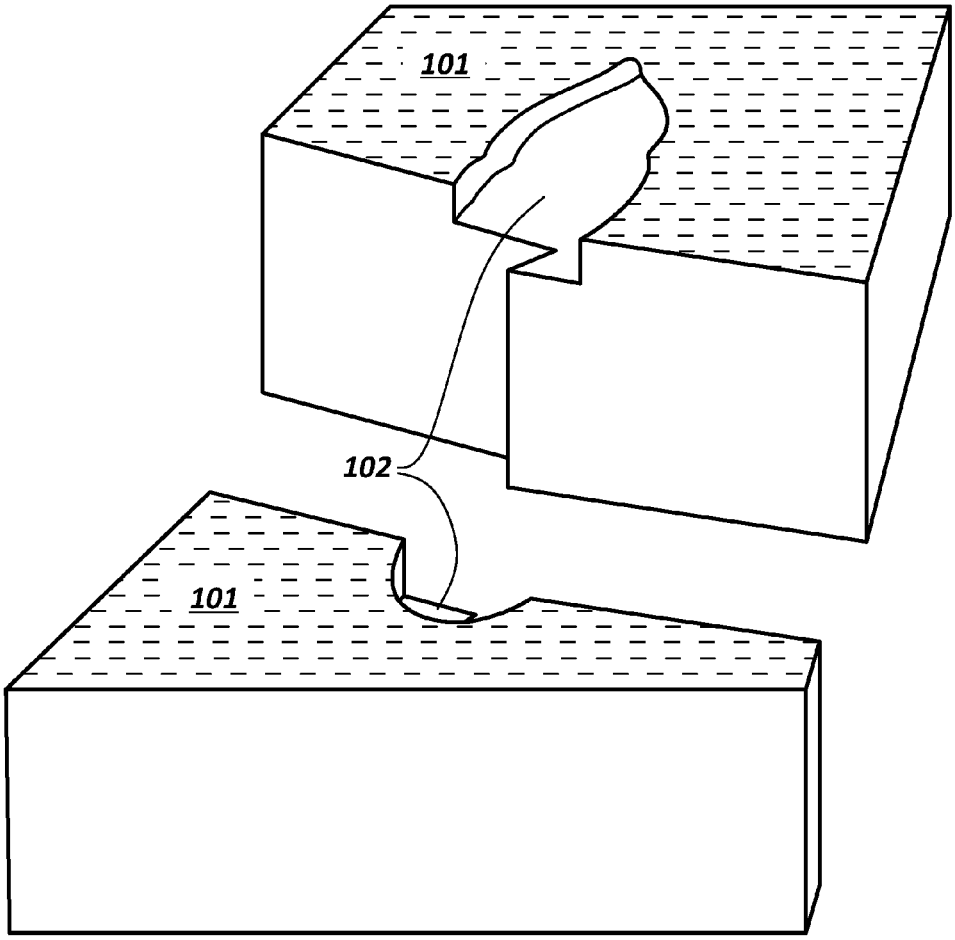
FIG. 1B illustrates an example of a void formed into the piece of stone of FIG. 1A.

FIG. 1B illustrates an example of void 102 formed into piece of stone 101. Void 102 can be cut into piece of stone 101 using a sandblaster and corresponding sandblasting stencil. The sandblasting stencil can be created with the assistance of a computer-aided plotter. The sandblasting stencil can be designed such that the resulting void can accommodate one or more pieces of glass. A CNC router with stone bit can be used to cut a void into a price of stone 101. Alternately, a (e.g., custom cut) stencil can be applied to piece of stone 101. Sandblasting or CNC router techniques can be used to cut void 102 into piece of stone 101. In some aspects, the void is cut so that after any pieces of glass are inlayed, a minimum of a 1 mm gap is present between the edge of the glass and the edge of the void.

The void can be cut to varying depths relative to the pieces of glass that are to be inlayed such that the glass is below the edge of the void, essentially level with the edge of the void, or above the edge of the void. In some aspects, the depth of the void is around 1 mm deeper than the depth of a piece of glass to be inlayed in the void. In other aspects, the depth of the void is somewhat more than 1 mm deeper than the depth of a piece of glass to be inlayed in the void. A somewhat deeper void can be cut intentionally but may also be cut accidentally. For example, when an installer sandblasts a void, he or she could intend to blast a void 1 mm deep but instead blast a void somewhat deeper than 1 mm (1.1 mm-1.5 mm) by accident. When appropriate, additional adhesive can be placed into the void to adjust void depth.

Figure 1C:
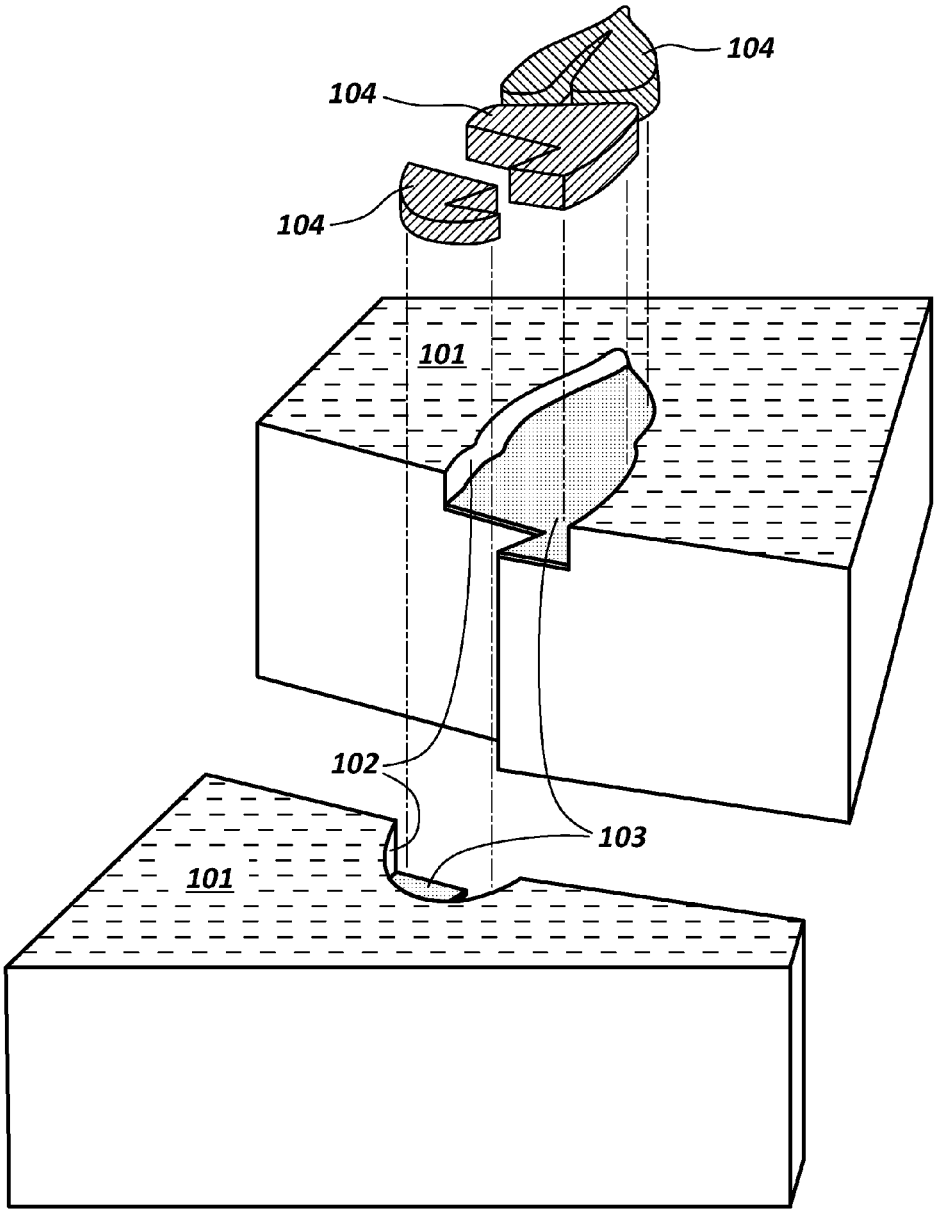
FIG. 1C illustrates an example of adhesive applied into the void in FIG. 1B and an example of pieces of glass relative to the piece of stone.

FIG. 1C illustrates an example of adhesive 103 applied into void 102 and an example of pieces of glass 104 relative to the piece of stone 101. Adhesive 103 is applied to the bottom surface of void 102, from wall to wall. In practice, adhesive 103 can be applied into void 102 and/or to a surface of a piece of glass 104 that is to contact the bottom surface of void 102. Adhesive 103 can be applied to into void 102 and to a piece of glass for 104 in any order (e.g., void first or glass first).

Figure 1D:
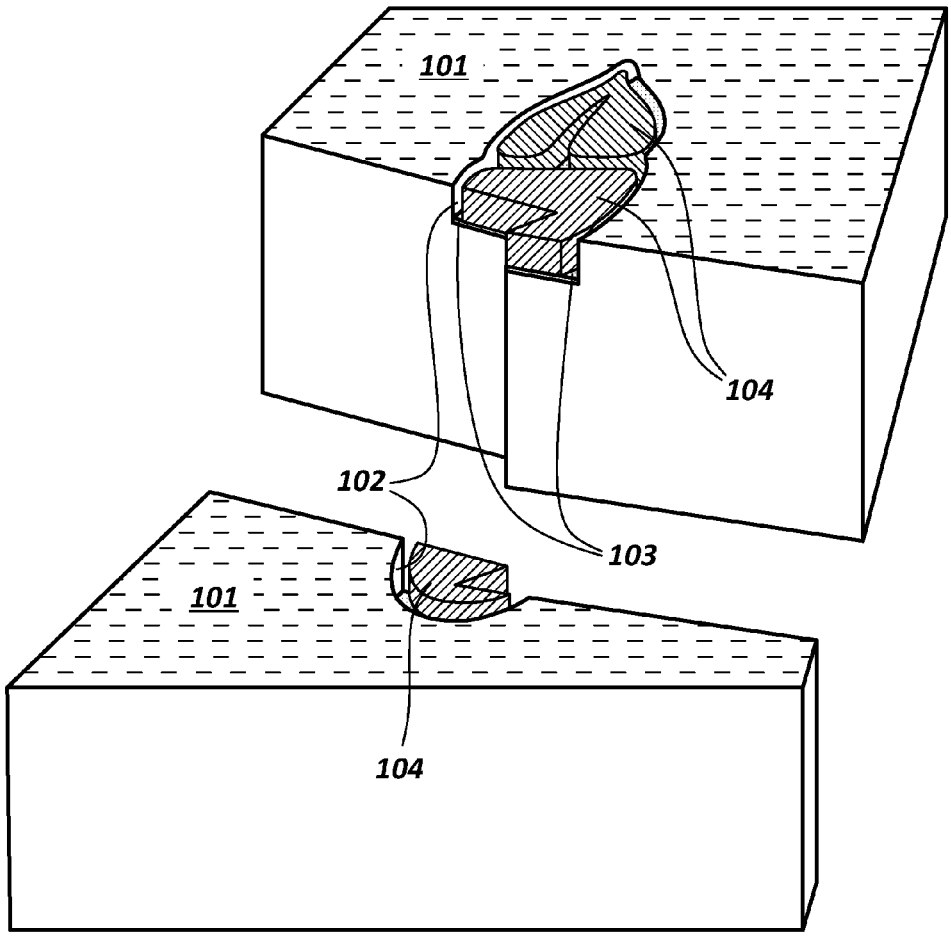
FIG. 1D illustrates an example of the pieces of glass pieces inlaid into the adhesive in the void of FIG. 1C.

FIG. 1D illustrates an example of pieces of glass pieces 104 inlaid into the adhesive 103 in void 102. After inlaying pieces of glass 104 there is an essentially uniform gap between the walls of void 102 and the edges of the pieces of glass 104. The pieces of glass 104 can be pressed into the void 102 for centering within void 102 and for leveling with the bottom surface of void 102. In some aspects, pieces of glass 104 are pressed into void 102 such that there are no air bubbles behind the prices of glass 104. When adhesive 103 is an epoxy adhesive it chemically bonds to the piece of stone 101 and pieces of glass 104. While remaining somewhat flexible, the bond has a tensile strength of over 1,000 kg and the strength of the stone is transferred to the glass via the bond.

Figure 1E:
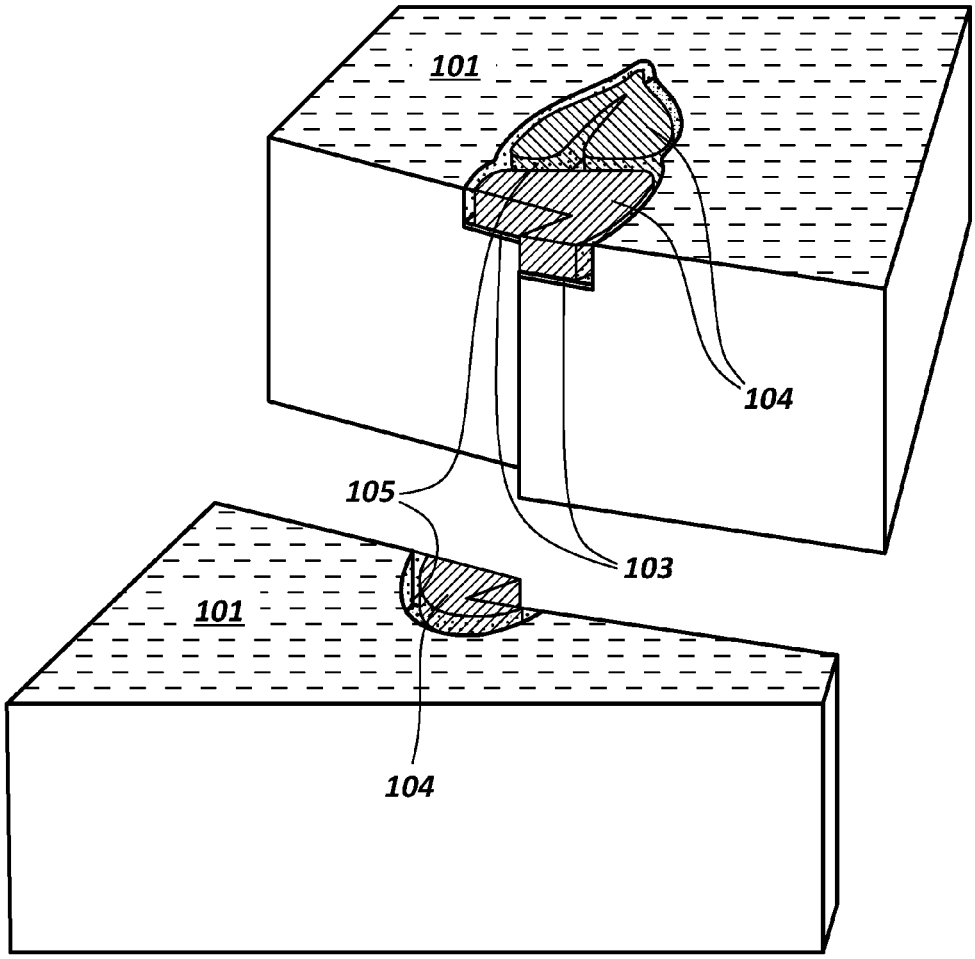
FIG. 1E illustrates an example of grout applied between the edges of the inlaid pieces of glass and the void FIG. 1D.

FIG. 1E illustrates an example of grout 105 applied between the edges of the pieces of glass 104 and the edge of void 102. When adhesive 103 sets, grout 105 (e.g., a cement based grout) can be applied to the gap between the pieces of glass 104 and the edge of void 102. Grout 105 can also be applied between the edges of a piece of glass as well as between the edges of adjacent pieces of glass 104. Grout 105 can be "sanded" or "non-sanded". Grout 105 helps affix pieces of glass 104 in place laterally. The grout 105 can compensate for thermal displacement (e.g., changes in temperature, freeze/thaw, etc.). Grout 105 also protects adhesive 103 from ultraviolet (UV) radiation. UV radiation has little, if any, effect on the strength of grout 105. As such, grout 105 significantly mitigates the possibility of adhesive 103 disincarnating and failing over time.

Grout 105 can be tinted (e.g., prior to placement) using lightfast and/or alkalinity fast pigments. Grout 105 can be kept moist for some amount of time (e.g., 24 hours). During that time grout 105 is kept moist, alkalinity in grout 105 etches the sidewalls of the glass and stone and therefore bonds the pieces of glass 104 and to piece of stone 101.

Although a single void 102 is depicted in piece of stone 101, multiple different voids can be formed into a piece of stone. One or more pieces of glass (e.g., glass inlays) can then be attached within each of the multiple different voids.

Accordingly, aspects of the invention are well suited for outdoor installations. When subject to outdoor conditions, colored glass can hold color significantly longer than coatings applied to stone. Further, applied grout can compensate for thermal displacement and protect underlying adhesive from UV radiation (both of which are more likely to occur outdoors).

Certain terms are used throughout the following description and Claims to refer to particular components. As one skilled in the art will appreciate, components may be referred to by different names. This document does not intend to distinguish between components that differ in name, but not function.

The described aspects may be implemented in other specific forms without departing from its spirit or essential characteristics. The described aspects are to be considered in all respects only as illustrative and not restrictive. The scope is, therefore, indicated by the appended claims rather than by the foregoing description. All changes which come within the meaning and range of equivalency of the claims are to be embraced within their scope.

What is claimed:

1. A method for bonding a glass inlay within a void in a piece of stone in a manner that prolongs the viability of an adhesive used to form the bond, the method comprising:

identifying an external perimeter of a glass inlay, the glass inlay having a size and shape and including one or more pieces of glass;

based on the external perimeter of the glass inlay, forming a void within a piece of stone, a size and shape of a perimeter of the void tailored to correspond to the size and shape of the glass inlay and to be at least 1 mm larger than the external perimeter of the glass inlay around the external perimeter of the glass inlay;

placing adhesive into the void, including areas of the void outside the external perimeter of the glass inlay;

placing the glass inlay on top of the adhesive within the void to bond the glass inlay to the piece of stone using the adhesive, placing the glass inlay leaving a gap of at least 1 mm between the external perimeter of the glass inlay and the perimeter of the void around the external perimeter of the glass inlay, adhesive present in the gap;

filling the gap with a cement-based grout to surround the external perimeter of the glass inlay with the cement-based grout and cover the adhesive present in the gap with the cement-based grout, the cement-based grout forming a barrier for preventing UV radiation from reaching the adhesive thereby prolonging the bond between the glass inlay and the piece of stone.

2. The method of claim 1, wherein the glass inlay is at least one of: opaque, solid colored, semi-transparent, or translucent.

3. The method of claim 1, wherein the glass inlay is one of: painted with ground colored glass or screen printed with ground colored glass.

4. The method of claim 1, wherein the glass inlay includes colored glass dust fused to the glass.

5. The method of claim 1, further comprising:

annealing the glass inlay in a kiln.

6. The method of claim 1, wherein, the adhesive is one of: an epoxy, mastic, or a polyester adhesive.

7. The method of claim 6, wherein placing the glass inlay within the void includes removing air bubbles in the adhesive placed into the void.

8. The method of claim 1, wherein the cement-based grout is one of: sanded grout or un-sanded grout.

9. The method of claim 1, wherein the cement-based grout is tinted using one of: lightfast pigments or alkalinity fast pigments.

10. The method of claim 1, further comprising:

prior to placing the glass inlay within the void, post-processing the glass inlay after cutting the one or more pieces of glass with a diamond-studded grinder or painting, fusing, and annealing the one or more pieces of glass.

11. The method of claim 1, where in the glass inlay is configured to be flush mounted, beveled or rounded, and/or protrude above the stone when placed.

12. A method for bonding a glass inlay consisting of a single piece of glass within a void in a piece of stone in a manner that prolongs the viability of an adhesive used to form the bond, the method comprising:

based on a perimeter of the glass inlay, forming a void within a piece of stone, a size and shape of a perimeter of the void tailored to correspond to a size and shape of the glass inlay and to be at least 1 mm larger than the perimeter of the glass inlay around the perimeter of the glass inlay;

placing the adhesive into the void;

subsequent to placing the adhesive into the void, placing the glass inlay within the void to bond the glass inlay to the piece of stone using the adhesive, the glass inlay being positioned within the void such that a gap of at least 1 mm exists between the perimeter of the void and the perimeter of the glass inlay around the perimeter of the glass inlay; and filling the gap with a cement-based grout to surround the perimeter of the glass inlay with the cement based grout and cover adhesive present in the gap with the cement-based grout, the cement-based grout: (a) forming a barrier for preventing UV radiation from reaching the adhesive and (b) compensating for thermal displacement of the glass inlay, thereby prolonging the bond between the glass inlay and the piece of stone.

* * * * *